US006799682B1

(12) United States Patent
Yoon

(10) Patent No.: US 6,799,682 B1
(45) Date of Patent: Oct. 5, 2004

(54) METHOD OF INCREASING FLOTATION RATE

(76) Inventor: Roe-Hoan Yoon, 2909 Wakefield Dr., Blacksburg, VA (US) 24060

( * ) Notice: Subject to any disclaimer, the term of this patent is extended or adjusted under 35 U.S.C. 154(b) by 0 days.

(21) Appl. No.: 09/573,441

(22) Filed: May 16, 2000

(51) Int. Cl.[7] ..... B03D 1/02; B03D 1/008; B03D 1/012; B03D 1/016

(52) U.S. Cl. ..... 209/166; 209/164

(58) Field of Search ..... 209/166, 164, 209/167; 252/61

(56) References Cited

U.S. PATENT DOCUMENTS

| | | | | |
|---|---|---|---|---|
| 1,064,723 A | | 6/1913 | Greenway et al. | |
| 1,102,873 A | | 7/1914 | Chapman et al. | |
| 1,208,171 A | | 12/1916 | Lavers et al. | |
| 1,452,662 A | * | 4/1923 | Smith | |
| 2,120,217 A | | 6/1938 | Harris | |
| 2,162,494 A | | 6/1939 | Trotter et al. | 209/166 |
| 2,864,765 A | | 12/1958 | Stoneman et al. | |
| 2,934,208 A | | 4/1960 | Schoeld et al. | 209/166 |
| 2,957,576 A | | 10/1960 | Henderson et al. | 209/167 |
| 3,464,551 A | * | 9/1969 | Falvey | |
| 3,480,143 A | | 11/1969 | Mitzmager et al. | 209/166 |
| 3,640,385 A | | 2/1972 | Smith et al. | 209/166 |
| 3,880,824 A | | 4/1975 | Rao et al. | |
| 3,964,997 A | * | 6/1976 | Weston | |
| 4,039,466 A | | 8/1977 | Matsuda et al. | |
| 4,144,969 A | * | 3/1979 | Snow | |
| 4,156,649 A | | 5/1979 | Quinn et al. | |
| 4,191,655 A | | 3/1980 | Quinn et al. | |
| 4,206,063 A | | 6/1980 | Wang et al. | |
| 4,207,186 A | | 6/1980 | Wang et al. | |
| 4,210,531 A | | 7/1980 | Wang et al. | |
| 4,278,208 A | | 7/1981 | Falcon-Steward | |
| 4,287,053 A | | 9/1981 | Lehr et al. | 209/167 |
| 4,308,133 A | | 12/1981 | Meyer | 209/166 |
| 4,324,653 A | | 4/1982 | Henchiri et al. | 209/167 |
| 4,410,431 A | | 10/1983 | Roe | 210/728 |
| 4,415,337 A | * | 11/1983 | Kutta et al. | |
| 4,447,344 A | | 5/1984 | Roe | |
| 4,507,198 A | | 3/1985 | Unger et al. | |
| 4,526,680 A | | 7/1985 | Owen | 209/166 |
| 4,532,032 A | | 7/1985 | Ng et al. | 209/166 |

(List continued on next page.)

FOREIGN PATENT DOCUMENTS

| | | | |
|---|---|---|---|
| CL | 32098 | 6/1980 | B03D/1/02 |
| CL | 35255 | 4/1986 | B03D/1/02 |

(List continued on next page.)

OTHER PUBLICATIONS

Yosry Attia and Shaning Yu; "Adsorption Thermodynamics of a Hydrophobic Polymeric Flocculant on Hydrophobic Polymeric Flocculant on Hydrophobic Colloidal Coal Particles"; Langmuir, vol. 7, No. 10, 1991, pp. 2203–2207.
Kevin D. Skiles; "Search for the Next Generation of Coal Flotation Collectors" pp. 189–204.

(List continued on next page.)

*Primary Examiner*—Thomas M. Lithgow
(74) *Attorney, Agent, or Firm*—Grossman, Tucker, Perreault & Pfleger, PLLC

(57) ABSTRACT

Methods of increasing the rate of separating hydrophobic and hydrophilic particles by flotation have been developed. They are based on using appropriate reagents to enhance the hydrophobicity of the particles to be floated, so that they can be more readily collected by the air bubbles used in flotation. The hydrophobicity-enhancing reagents include low HLB surfactants, naturally occurring lipids, modified lipids, and hydrophobic polymers. These methods can greatly increase the rate of flotation for the particles that are usually difficult to float, such as ultrafine particles, coarse particles, middlings, and the particles that do not readily float in the water containing large amounts of ions derived from the particles. In addition, new collectos for the flotation of phosphate minerals are disclosed.

9 Claims, 4 Drawing Sheets

U.S. PATENT DOCUMENTS

| | | | | | |
|---|---|---|---|---|---|
| 4,561,953 | A | | 12/1985 | Muralidhara et al. | |
| 4,589,980 | A | * | 5/1986 | Keys | |
| 4,678,561 | A | * | 7/1987 | Keys | |
| 4,678,562 | A | * | 7/1987 | Keys | |
| 4,678,563 | A | | 7/1987 | Keys | 209/166 |
| 4,690,752 | A | | 9/1987 | Shaw | 209/5 |
| 4,701,257 | A | | 10/1987 | Hefner, Jr. | 209/166 |
| 4,770,766 | A | | 9/1988 | Keller, Jr. et al. | |
| 4,857,221 | A | | 8/1989 | Brookes et al. | 252/61 |
| 4,859,318 | A | | 8/1989 | Brookes et al. | 209/166 |
| 4,866,856 | A | | 9/1989 | Feeley | |
| 4,902,764 | A | | 2/1990 | Rothenberg et al. | 526/240 |
| 4,956,077 | A | | 9/1990 | Barwise | 209/166 |
| 4,966,712 | A | | 10/1990 | Nishibayashi et al. | 210/705 |
| 4,969,928 | A | | 11/1990 | Wen et al. | |
| 5,011,612 | A | | 4/1991 | Keeney | |
| 5,048,199 | A | | 9/1991 | Cole | |
| 5,057,209 | A | | 10/1991 | Klimpel et al. | 209/167 |
| 5,161,694 | A | | 11/1992 | Yoon et al. | |
| 5,167,831 | A | | 12/1992 | Dimas | |
| 5,215,669 | A | | 6/1993 | Koester et al. | |
| 5,256,169 | A | | 10/1993 | Roe | |
| 5,283,322 | A | | 2/1994 | Martin et al. | |
| 5,346,630 | A | | 9/1994 | Kenney | |
| 5,379,902 | A | | 1/1995 | Wen et al. | |
| 5,405,554 | A | | 4/1995 | Neff et al. | |
| 5,407,080 | A | | 4/1995 | Welch et al. | 209/166 |
| 5,441,156 | A | * | 8/1995 | Fabry et al. | |
| 5,443,158 | A | * | 8/1995 | McKenny et al. | |
| 5,458,786 | A | | 10/1995 | Yoon et al. | |
| 5,544,760 | A | | 8/1996 | Benn et al. | 209/166 |
| 5,587,786 | A | | 12/1996 | Champagne et al. | |
| 5,670,056 | A | | 9/1997 | Yoon et al. | |
| 5,700,904 | A | | 12/1997 | Baker et al. | |
| 5,756,622 | A | | 5/1998 | Wang et al. | 526/288 |
| 5,814,210 | A | | 9/1998 | Yoon et al. | 209/164 |
| 5,959,054 | A | | 9/1999 | Wang et al. | 526/288 |
| 6,375,853 | B1 | | 4/2002 | Yoon | 210/727 |

FOREIGN PATENT DOCUMENTS

| | | | | | |
|---|---|---|---|---|---|
| CL | 35536 | | | 3/1987 | B03D/1/02 |
| CL | 1503-1994 | | | 12/1995 | B03B/1/04 |
| CL | 1112-1995 | | | 5/1996 | B03D/1/008 |
| CL | 1152-97 | | | 6/1997 | |
| DE | 3107305 | A1 | | 9/1982 | B03D/1/00 |
| DE | 3517154 | A1 | | 11/1986 | B03D/1/02 |
| GB | 738061 | | | 10/1955 | |
| GB | 2093735 | | | 9/1982 | B03B/1/04 |
| GB | 2171336 | | * | 8/1986 | |
| GB | 2212418 | A | | 7/1989 | B03D/1/02 |
| GB | 2254021 | A | | 9/1992 | B03D/1/02 |
| JP | 61025651 | | | 2/1986 | B03D/1/02 |
| SU | 810286 | | | 3/1981 | B03D/1/02 |
| SU | 822903 | | | 4/1981 | B03D/1/02 |
| SU | 839575 | | | 6/1981 | B03D/1/02 |
| SU | 1041156 | | | 9/1983 | B03D/1/02 |
| SU | 1131540 | | | 12/1984 | B03D/1/02 |
| WO | WO97/25149 | | | 7/1997 | B03D/1/012 |
| WO | WO00/09268 | | | 2/2000 | B03D/1/02 |
| WO | WO/00/09268 | | | 2/2000 | B03D/1/02 |
| WO | WO01/87490 | A1 | | 11/2001 | B03D/1/008 |
| ZA | 8602192 | | | 11/1986 | |

OTHER PUBLICATIONS

F.F. Aplan; "How the Nature of Raw Coal Influences Its Cleaning"; Industrial Practice of Fine Coal Processing; pp. 99–111.

Roe–Hoan Yoon; "Part 2: Advanced Coal Cleaning"; Coal Preparation; pp. 966–1005.

William G. Steedman and Santhana V. Krishnan; "Oil Agglomeration Process for the Treatment of Fine Coal"; Fine Oil Processing; pp. 179–204.

U.S. application Ser. No. 09/327,266 filed Jun. 07, 1999 for "Method of Enhancing Fine Particle Dewatering".

U.S. application Ser. No. 09/326,330 filed Jun. 7, 1999 for "Method of Using Natural Products as Dewatering Aids for Fine Particles".

Roe–Hoan Yoon and S.A. Ravishankar, "Long–Range Hydrophobic Forces between Mica Surfaces in Alkaline Dodecylammonium Chloride Solutions" 1996, Journal of Colloid and Interfaces Science, 179, pp. 403–411.

Laiqun Mao and Roe–Hoan Yoon, "Predicting flotation rates using a rate equation derived from first principles" 1997, International Journal of Mineral Processing, 51, pp. 171–181.

Roe–Hoan Yoon and B. Suha Aksoy, "Hydrophobic Forces in Thin Water Films Stabilized by Dodecylammonium Chloride" 1999, Journal of Colloid and Interface Science, 211, pp. 1–10.

Roe–Hoan Yoon and Laiquin Mao, "Application of Extended DLVO Theory, IV Derivation of Flotation Rate Equation from First Principles" 1996, Journal of Colloid and Interface Science, 181, pp. 613–626.

Roe–Hoan Yoon, Darrin H. Flinn and Yakov I. Rabinovich, "Hydrophobic Interactions between Dissimilar Surfaces" 1997, Journal of Colloid and Interface Science, 185, pp. 363–370.

Yoon and Ravishankar, "Long–Range Hydrophobic Forces Between Mica Surfaces in Dodecylammonium Chloride Solutions in the Presence of Dodecanol," J. Colloid and Interface Science, vol. 179, pp. 391–402, 1996.

Mao and Yoon, "Predicting Flotation Rates Using a Rate Equation Derived from First Principles," International Journal of Mineral Processing, vol. 50, pp. 171–181, 1996.

Yoon and Aksoy, "Hydrophoic Forces in Thin Water Films Stabilized by Dodecylammonium Chloride," J. Colloid and Interface Sience, vol. 211, pp. 1–10, 1996.

U.S. patent application Ser. No. 09/368,945, Yoon.

U.S. patent application Ser. No. 09/326,330, Yoon.

* cited by examiner

METHOD OF INCREASING FLOTATION RATE

BACKGROUND

In the mining industry, mined ores and coal are upgraded using appropriate separation method. They are usually crushed and/or pulverized to detach (or liberate) the valuable components from waste rocks prior to subjecting them to appropriate solid-solid separation methods. Although coal is not usually pulverized as finely as ores, a significant portion of a crushed coal is present as fines. Froth flotation is the most widely used method of separating the valuables from valueless present in the fines. In this process, the fine particles are dispersed in water and small air bubbles are introduced to the slurry, so that hydrophobic particles are selectively collected on the surface of the air bubbles and exit the slurry while hydrophilic particles are left behind.

A small dose of surfactants, known as collectors, are usually added to the aqueous slurry to render one type (or group) of particles hydrophobic, leaving others unaffected. For the case of processing high-rank coals, no collectors are necessary as the coal is naturally hydrophobic. When the coal particles are not sufficiently hydrophobic, however, hydrocarbon oils such as diesel oil or kerosene are added to enhance their hydrophobicity.

It has been shown recently that air bubbles are hydrophobic (Yoon and Aksoy, J. Colloid and Interface Science, vol. 211, pp. 1–10, 1999). It is believed, therefore, that air bubbles and hydrophobic particles are attracted to each other by hydrophobic interaction.

The floated products, which are usually the valuables, are in the form of aqueous slurry, typically in the range of 10 to 35% solids. They are dewatered frequently by filtration prior to further processing or shipping to consumers. The process of dewatering is often described by means of the Laplace equation:

$$\Delta p = \frac{2\gamma_{23}\cos\theta}{r}, \quad [1]$$

in which r is the average radius of the capillaries formed in between the particles that make up a filter cake, $\Delta p$ the pressure of the water inside the capillaries, $\gamma_{23}$ the surface tension at the water(3)-air(2) interface and $\theta$ is the contact angle of the particles constituting the filter cake. The capillary water can be removed when the pressure drop applied across the cake during the process of filtration exceeds $\Delta p$. Thus, a decrease in $\gamma_{23}$ and $\theta$, and an increase in r should help decrease $\Delta p$ and thereby facilitate the process of dewatering.

The U.S. Pat. No. 5,670,056 disclosed a method of using hydrophobizing agents that can increase the contact angle ($\theta$) above 65° and, thereby, facilitate dewatering processes. Mono-unsaturated fatty esters, fatty esters whose hydruphile-lipophile balance (HLB) numbers are less than 10, and water-soluble polymethylhydrosiloxanes were used as hydrophobizing agents. More recently, a series of U.S. patents have been applied for to disclose the methods of using a group of nonionic surfactants with HLB numbers in the range of 1 to 15, See U.S. patent application Ser. No. 09/368,945, entitled "Methods for Using Modified Natural Products as Dewatering Aids for Fine Particles, naturally occurring lipids, U.S. patent application Ser. No. 09/326,330, filed Jun. 7, 1999, and a U.S. patent application filed Mar. 21, 2000 and entitled, "Methods of Improving Centrifugal Filtration" by H. Yoon on modified lipids to increase $\theta$ beyond the level that can normally be achieved using flotation collectors and, hence, improve dewatering. The contents of the above three patent applications are hereby incorporated herein by reference.

Ever since the flotation technology was introduced to the mining industry, its practitioners have been seeking for appropriate collectors that can increase $\theta$ as much as possible without causing unwanted minerals inadvertently hydrophobic. A theoretical model developed by Mao and Yoon (International Journal of Mineral Processing, vol. 50, pp. 171–181, 1996) showed that an increase in $\theta$ can increase the rate at which air bubbles can collect hydrophobic particles.

OBJECTS OF THE INVENTION

From the foregoing, it should be apparent to the reader that one obvious object of the present invention is the provision of novel methods of enhancing the hydrophobicity of the particles to be floated beyond the level that can be achieved using collectors, so that the rate of bubble-particle attachment and, hence, the rate of flotation can be increased.

Another important objective of the invention is the provision of increasing the hydrophobicity difference between the particles to be floated and those that are not to be floated, so that the selectivity of the flotation process can be increased.

An additional objective of the present invention is the provision of increasing the hydrophobicity of the particles that are usually difficult to be floated such as coarse particles, ultrafine particles, oxidized particles, and the particles that are difficult to be floated in solutions containing high levels of dissolved ions.

Still another object of the present invention is the provision of a novel collector for the flotation of phosphate minerals that are more effective than the fatty acids that are most commonly used today.

SUMMARY OF THE INVENTION

The present invention discloses methods of increasing the rate of flotation, in which air bubbles are used to separate hydrophobic particles from hydrophilic particles. In this process, the hydrophobic particles adhere on the surface of the air bubbles and subsequently rise to the surface of the flotation pulp, while hydrophilic particles not collected by the air bubbles remain in the pulp. Since air bubbles are hydrophobic, the driving force for the bubble-particle adhesion may be the hydrophobic attraction. Therefore, one can improve the rate of bubble-particle adhesion and, hence, the rate of flotation by increasing the hydrophobicity of the particles to be floated.

In conventional flotation processes, appropriate collectors (mostly surfactants) are used to render selected particles hydrophobic. The collector molecules adsorb on the surface of the particles with their polar groups serving effectively as 'anchors', leaving the hydrocarbon tails (or hydrophobes) exposed to the aqueous phase. Since the hydrocarbon tails are hydrophobic, the collector-coated surfaces acquire hydrophobicity, which is a prerequisite for flotation. In general, the higher the packing density of the hydrophobes on a surface, the stronger the surface hydrophobicity.

A conventional measure of hydrophobicity is water contact angle ($\theta$). Thermodynamically, the higher the contact angle, the more favorable the flotation becomes. Therefore, there is a need to increase the hydrophobicity as much as possible. Unfortunately, collector coatings do not often result in the formation of close-packed monolayers of hydrophobes. The polar groups of collector molecules can adsorb only on certain sites of the surface of a particle, while the site density does not usually allow formation of close-packed monolayers of hydrophobes.

It has been found in the present invention that certain groups of reagents can be used in addition to collectors to further increase the packing density of hydrophobes and, thereby, enhance the hydrophobicity of the particles to be floated. Four groups of reagents have been identified. These include nonionic surfactants of low HLB numbers, naturally occurring lipids, modified lipids, and hydrophobic polymers. These reagents, having no highly polar groups in their molecules, can adsorb in between the hydrocarbon chains of the collector molecules adsorbed on the surface of particles. Most of the hydrophobicity-enhancing reagents used in the present invention are insoluble in water, in which case appropriate solvents may be used to carry the reagents and spread them on the surface. However, some of the reagents may be used directly without solvents.

The solvents for the hydrophobicity-enhancing reagents may include but not limited to short-chain aliphatic hydrocarbons, aromatic hydrocarbons, light hydrocarbon oils, glycols, glycol ethers, ketones, short-chain alcohols, ethers, petroleum ethers, petroleum distillates, naphtha, glycerols, chlorinated hydrocarbons, carbon tetrachloride, carbon disulfide, and polar aprotic solvents such as dimethyl sulfoxide, dimetyl formamide, and N-methyl pyrrolidone. The amounts of solvents required vary depending on the type of hydrophobicity-enhancing reagents and the type of solvents used.

In the flotation industry, different types of collectors are used for different minerals. For the flotation of sulfide minerals, thiol-type collectors are used. For the flotation of oxide minerals, high HLB surfactants are used. For the flotation of naturally hydrophobic coal and minerals, hydrocarbon oils such as fuel oils are used. The hydrophobicity-enhancing reagents disclosed in the present invention can be used for any type of minerals, because these reagents interact primarily with the hydrocarbon chains of the collector molecules adsorbed on the surface.

The benefits of using the hydrophobicity-enhancing reagents can be seen with all types of particles present in a flotation cell. However, the most significant improvements can be obtained with the particles that are either too small or too large to be floated. For the case of minerals, it is difficult to float particles smaller than 0.01 mm and larger than 0.15 mm. The novel hydrophobicity-enhancing reagents are also useful for the flotation of minerals that have become considerably hydrophilic due to oxidation.

In the phosphate minerals industry, fatty acids are commonly used as collectors. However, their efficiency deteriorates when the plant water contains high levels of phosphate ions. This problem can be readily overcome by using the novel hydrophobicity-enhancing reagents disclosed in the present invention in addition to a small amount of fatty acids. It has been found also that phosphate esters can be used as standalone collectors for phosphate minerals. These new collectors are effective in solutions containing high levels of dissolved phosphate ions.

DETAILED DESCRIPTION OF THE INVENTION

Figure 1:
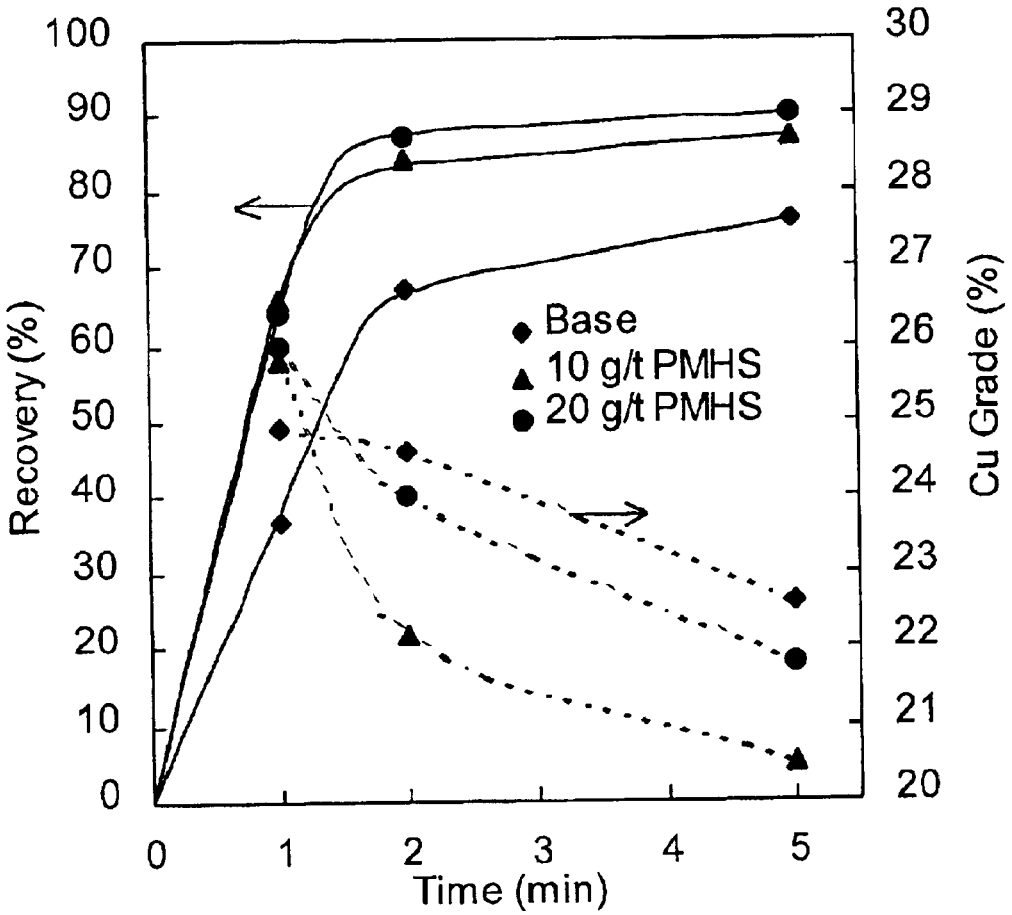
FIG. 1 is a graph of the flotation kinetics test for example 1.

The process of air bubbles collecting hydrophobic particles is the most elementary and essential step in flotation. The free energy changes associated with this process can be given by the following relationship:

$$\Delta G = \gamma_{12} - \gamma_{13} - \gamma_{23} < 0 \quad [2]$$

in which $\gamma_{12}$ is the surface free energy at the solid-air interface, $\gamma_{13}$ the surface free energy at the solid-water interface, and $\gamma_{23}$ has the same meaning as in Eq. [1].

In flotation research, contact angles, $\theta$, are usually measured using the captive bubble technique. In this technique, an air bubble is brought to a hydrophobic surface so that the solid/liquid interface is displaced by the solid/air interface. In effect, the contact angle (measured through the aqueous phase) gives the extent at which the air bubble has displaced the water from the surface. According to the Young's equation, the contact angle is given by $$\cos\theta = \frac{\gamma_{13} - \gamma_{12}}{\gamma_{23}}. \quad [3]$$

Substituting this into Eq. [2], one obtains:

$$\Delta G = \gamma_{23}(\cos\theta - 1) < 0, \quad [4]$$

which suggests that air bubbles can collect particles during flotation if $\theta > 0$. It shows also that the higher the value of $\theta$, the free energy of bubble-particle interaction becomes more negative. Therefore, it would be desirable to find appropriate methods of increasing $\theta$ for flotation.

It is well known that flotation is difficult when the particle size to be floated becomes too small or too large. For the case of floating minerals, the particles that are outside the 0.01 to 0.15 mm range are difficult to float. For the case of floating coal, somewhat larger particles (up to 0.25 mm) can be readily floated because their specific gravities are smaller than those of the minerals. The difficulty in floating fine particles was attributed to the low probability of collision between air bubbles and particles, while the difficulty in floating coarse particles is caused by the high probability of the particles being detached during flotation. According to Eq. [4], it would be more difficult to detach a particle if $\theta$ can be increased by appropriate means. Thus, increase in contact angle should decrease the probability of detachment and, hence, promote the floatability of coarse particles. It is also well known that fine particles coagulate with each other in aqueous media when they are hydrophobic (U.S. Pat. No. 5,161,694) and form large coagula. Therefore, increase in hydrophobicity should help minimize the difficulty in floating fine particles.

In the present invention, novel reagents are used to enhance the hydrophobicity of the particles that are naturally hydrophobic or have been hydrophobized using a collector, combinations of collectors, or combinations of collectors and frothers. The novel hydrophobicity enhancing reagents include nonionic surfactants of low HLB numbers, naturally occurring lipids, modified lipids, and hydrophobic polymers. The use of these reagents will result in an increase in the contact angles ($\theta$) of the particles to be floated so that their flotation rate is increased. The beneficial effects of using these reagents are particularly pronounced with the minerals and coal that are difficult to float, i.e., fine particles, coarse particles, oxidized particles, and middlings particles containing both hydrophobic and hydrophilic grains.

The collectors that are used to hydrophobize minerals are usually surfactants. They adsorb on the surface of a mineral with their polar head groups in contact with the surface and their hydrocarbon tails pointing toward the aqueous phase. As a result, the collector adsorption produces a coating of hydrocarbon tails (or hydrophobes) and thereby renders the surface hydrophobic. The more closely packed the hydrocarbon tails are, the more hydrophobic the surface of the mineral would become. However, the population of the surface sites on which the collector molecules can adsorb is usually well below what is needed to form a close-packed monolayer of the hydrophobes. The hydrophobicity-enhancing reagents used in the present invention are designed to adsorb in between the spaces created between the hydrocarbon tails of the collector molecules adsorbed or adsorbing on the surface. This will allow the mineral surface to be more fully covered by hydrophobes. It has been shown that the magnitudes of the attractive hydrophobic forces increase sharply when close-packed layers of hydrocarbon tails are formed on a mineral surface (Yoon and Ravishankar, J. Colloid and Interface Science, vol. 179, p. 391, 1996).

The first group of the hydrophobicity enhancing surfactants are the nonionic surfactants whose HLB numbers are below approximately 15. These include fatty acids, fatty esters, phosphate esters, hydrophobic polymers, ethers, glycol derivatives, sarcosine derivatives, silicon-based surfactants and polymers, sorbitan derivatives, sucrose and glucose esters and derivatives, lanolin-based derivatives, glycerol esters, ethoxylated fatty esters, ethoxylated amines and amnides, ethoxylated linear alcohols, ethoxylated tryglycerides, ethoylated vegetable oils, ethoxylated fatty acids, etc.

The second group of hydrophobicity enhancing reagents are the naturally occurring lipids. These are naturally occurring organic molecules that can be isolated from plant and animal cells (and tissues) by extraction with nonpolar organic solvents. Large parts of the molecules are hydrocarbons (or hydrophobes); therefore, they are insoluble in water but soluble in organic solvents such as ether, chloroform, benzene, or an alkane. Thus, the definition of lipids is based on the physical property (i.e., hydrophobicity and solubility) rather than by structure or chemical composition. Lipids include a wide variety of molecules of different structures, i.e., triacylglycerols, steroids, waxes, phospholipids, sphingolipids, terpenes, and carboxylic acids. They can be found in various vegetable oils (e.g., soybean oil, peanut oil, olive oil, linseed oil, sesame oil), fish oils, butter, and animal oils (e.g., lard and tallow). Although fats and oils appear different, that is, the former are solids and the latter are liquids at room temperature, their structures are closely related. Chemically, both are triacylglycerols; that is, triesters of glycerol with three long-chain carboxylic acids. They can be readily hydrolyzed to fatty acids. Corn oil, for example, can be hydrolyzed to obtain mixtures of fatty acids, which consists of 35% oleic acid, 45% linoleic acid and 10% palmitic acid. The hydrolysis products of olive oil, on the other hand, consist of 80% oleic acid. Waxes can also be hydrolyzed, while steroids cannot. Vegetable fats and oils are usually produced by expression and solvent extraction or a combination of the two. Pentane is widely used for solvent, and is capable of extracting 98% of soybean oil. Some of the impurities present in crude oil, such as free fatty acids and phospholipids, are removed from crude vegetable oils by alkali refining and precipitation. Animal oils are produced usually by rendering fats.

The triacylglycerols present in the naturally occurring lipids may be considered to be large surfactant molecules with three hydrocarbon tails, which may be too large to be adsorbed in between the hydrocarbon tails of the collector molecules adsorbed or adsorbing on the surface of a mineral. Therefore, the third group of hydrophobicity-enhancing reagents is the naturally occurring lipid molecules that have been broken by using one of several different molecular restructuring processes. In one method, the triacylglycerols are subjected to transesterification reactions to produce monoesters. Typically, an animal fat or oil is mixed with an alcohol and agitated in the presence of a catalyst usually $H^+$ or $OH^-$ ions. If methanol is used, for example, in stoichiometric excess, the reaction products will include methyl fatty esters of different chain lengths and structures and glycerol. The reactions can be carried out at room temperature; however, the reactions may be carried out at elevated temperature in the range of 40 to 80° C. to expedite the reaction rate.

In another method of molecular modification, triacylglycerols are hydrolyzed to form fatty acids. They can be hydrolyzed in the presence of $H^+$ or $OH^-$ ions. In the case of using the $OH^-$ ions as catalyst, the fatty acid soaps formed by the saponification reactions are converted to fatty acids by adding an appropriate acid. The fatty acid soaps are high HLB surfactants and, therefore, are not suitable as hydrophobicity enhancing agents.

In still another method, triacylglycerols are reacted with glycerol to produce a mixture of esters containing one or two acyl groups. This reaction is referred to as interesterification.

Other methods of molecular modification would be to convert triacylglycerols to amides by reacting them with primary and secondary amines, or to thio-esters by reacting them with thiols in the presence of acid or base catalysts.

The process of breaking and modifying the lipid molecules are simple and, hence, do not incur high costs. Furthermore, the reaction products may be used without further purification, which contributes further to reducing the reagent costs.

The acyl groups of the naturally occurring lipids contain even number of hydrocarbons between 12 and 20, and may be either saturated or unsaturated. The unsaturated acyl groups usually have cis geometry, which is not conducive to forming close-packed monolayers of hydrocarbons. Some of the lipids have higher degrees of unsaturation than others. Therefore, it is desirable to either use the lipids containing lower degree of unsaturation as they occur in nature, or use the lipids containing higher degree of unsaturation after hydrogenation. The hydrogenation can decrease the degree of unsaturation of the acyl groups. This technique can be applied to naturally occurring lipids, or after breaking the triacylglycerols present in the naturally occurring lipids to smaller molecules using the methods described above.

The fourth group of hydrophobicity enhancing reagents are the hydrophobic polymers such as polymethylhydrosiloxanes, polysilanes, polyethylene derivatives, and hydrocarbon polymers generated by both ring-opening metathesis and methalocene catalyzed polymerization.

Many of the hydrophobicity-enhancing reagents disclosed in the present invention are not readily soluble in water. Therefore, they may be used in conjunction with appropriate solvents, which include but not limited to light hydrocarbon oils, petroleum ethers, short-chain alcohols short-chain alcohols whose carbon atom numbers are less than eight, and any other reagents, that can readily dissolve or disperse the reagents in aqueous media. The light hydrocarbon oils include diesel oil, kerosene, gasoline, petroleum distillate, turpentine, naphtanic oils, etc. Typically, one part by volume of a lipid, which may be termed as active ingredient(s), is dissolved in 0.1 to two parts of a solvent before use. The amount of the solvents required depends on the solvation power of the solvents used. In some cases, more than one type of solvents may be used to be more effective or more economical. Some of the hydrophobicity-enhancing reagents may be used without solvents.

The third group of hydrophobicity-enhancing reagents used in the present invention are smaller in molecular size than the naturally occurring lipids. Therefore, they are more conducive to creating close-packed monolayers of hydrophobes and, hence, to increasing contact angles. Also, any of the reagents disclosed in the present invention becomes more effective when the hydrocarbon tails are mostly saturated either naturally or via hydrogenation.

TEST PROCEDURE

The novel hydrophobicity-enhancing reagents disclosed in the present invention were tested in both laboratory and full-scale flotation tests. In a given laboratory test, an ore pulp was conditioned with a conventional collector to render the surface of the particles to be floated moderately hydrophobic. The ore pulp was conditioned again with a hydrophobicity-enhancing reagent to increase the hydrophobicity. After adding a frother, air was introduced to the ore pulp, so that air bubbles collect the strongly hydrophobic particles, rose to the surface of the pulp, and form a froth phase. The froth was removed into a pail, filtered, dried, weighed, and analyzed. In some cases, the froth product was repulped and subjected to another stage of flotation test. The first flotation step is referred to as rougher, and the second flotation step as cleaner. For the case of in-plant test, a hydrophobicity-enhancing reagent was added to a conditioning tank. The conditioned slurry was then pumped to a bank of flotation cell. Representative amounts of the froth product and the tail were taken and analyzed.

EXAMPLES

Example 1

A porphyry-type copper ore from Chuquicamata mine, Chile, (assaying about 1% Cu), was subjected to a set of three flotation tests. In each test, approximately 1 kg of the ore sample was wet-ground in a laboratory ball mill at 66% solids. Lime and diesel oil (5 g/t) was added to the mill. In the control test, the mill discharge was transferred to a Denver laboratory flotation cell, and conditioned with 5 g/ton of a conventional thiol-type collector (Shellfloat 758) for 1 minutes at pH 10.5. Flotation test was conducted for 5 minutes with 20 g/t methylisobutyl carbinol (MIBC) as a frother. Froth products were collected for the first 1, 2, and 5 minutes of flotation time, and analyzed separately to obtain kinetic information.

The next two tests were conducted using polymethyl hydrosiloxane (PMHS) in addition to the thiol-type collector. This reagent is a water-soluble hydrophobic polymer, whose role was to enhance the hydrophobicity of the mineral to be floated (chalcopyrite) beyond the level that could be attained with Shellfloat 758 alone. The hydrophobicity-enhancing reagent was added after the 1 minute conditioning time with the Shellfloat, and conditioned for another 2 minutes. In one test, 10 g/t PMHS was used, while in another 20 g/t PMHS was used.

Figure 2:
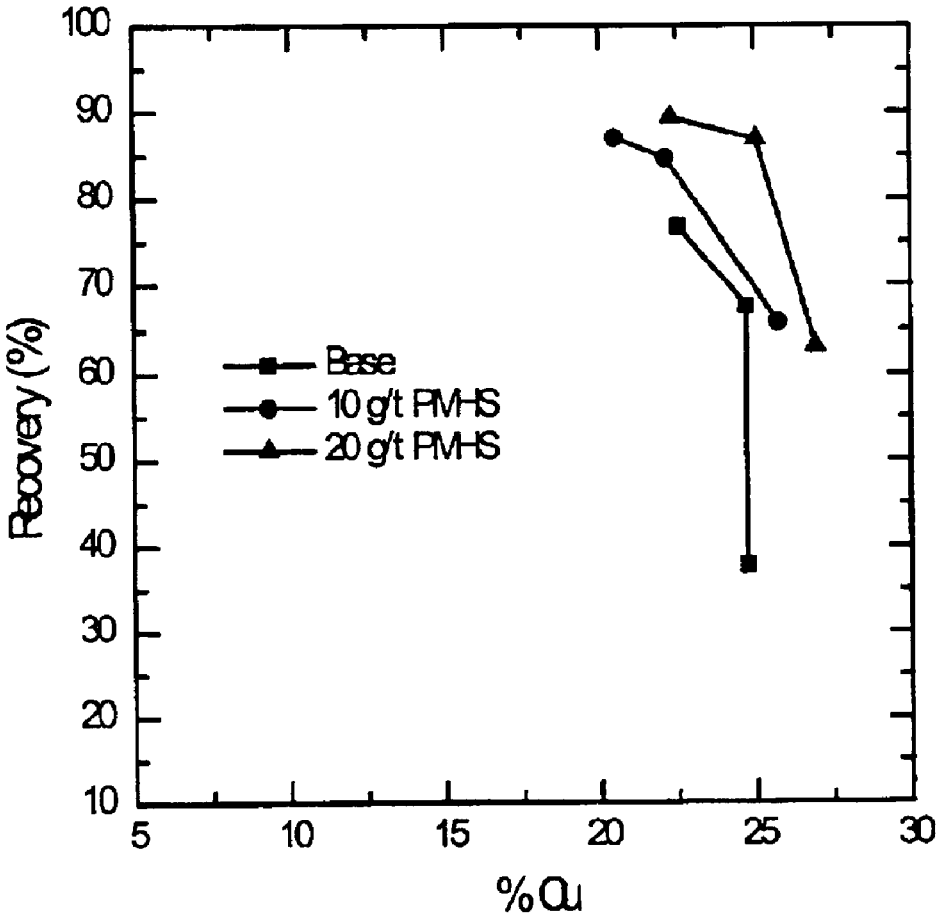
FIG. 2 is a graph of the grade vs. recovery curves for example 1.

The results of the flotation kinetics tests are given in FIG. 1, in which the solid lines represent the changes in recovery with time and the dotted lines show the changes in grade. Note that the use of PMHS substantially increased the initial slopes of the recovery vs. time curves, which indicated that the use of the novel hydrophobicity-enhancing reagent increased the kinetics of flotation. The improved kinetics was responsible for the substantial increase in copper recovery obtained using PMHS. The increase in recovery caused a decrease in grade. However, the decrease in grade was far outweighed by the substantial increase in recovery, which can be seen more clearly in the grade vs. recovery curves shown in FIG. 2.

Example 2

Another porphyry-type copper ore was tested using PMHS as a hydrophobicity-enhancing agent. The ore sample was from El Teniente Mine, Chile, and assayed 1.1% Cu. In each test, approximately 1 kg of the ore sample was wet-ground for 9 minutes with lime and diesel oil (15 g/t). The mill discharge was conditioned in a Denver laboratory flotation cell for 1 minute with Shellfloat 758 at pH 11. Flotation tests were conducted for 5 minutes using 20 g/t of MIBC as frother. The froth products were collected for the first 1, 2, and 5 minutes of flotation time, and analyzed separately to obtain kinetic information.

Two sets of tests were conducted with the El Teniente ore samples. In the first set, three flotation tests were conducted using 21 g/t Shellfloat 758. One test was conducted without using any hydrophobicity-enhancing reagent. In another, 15 g/t of sodium isopropyl xanthate (IPX) was used in addition to the Shellfloat (SF). In still another, 7.5 g/t of PMIHS was used as a hydrophobicity-enhancing reagent. The results are plotted in FIG. 3, which show that the IPX addition actually caused a decrease in recovery, while the PMHS addition caused a substantial increase. In this figure, the numbers in the legend refer to reagent additions in grams per tonne (g/t).

Figure 3:
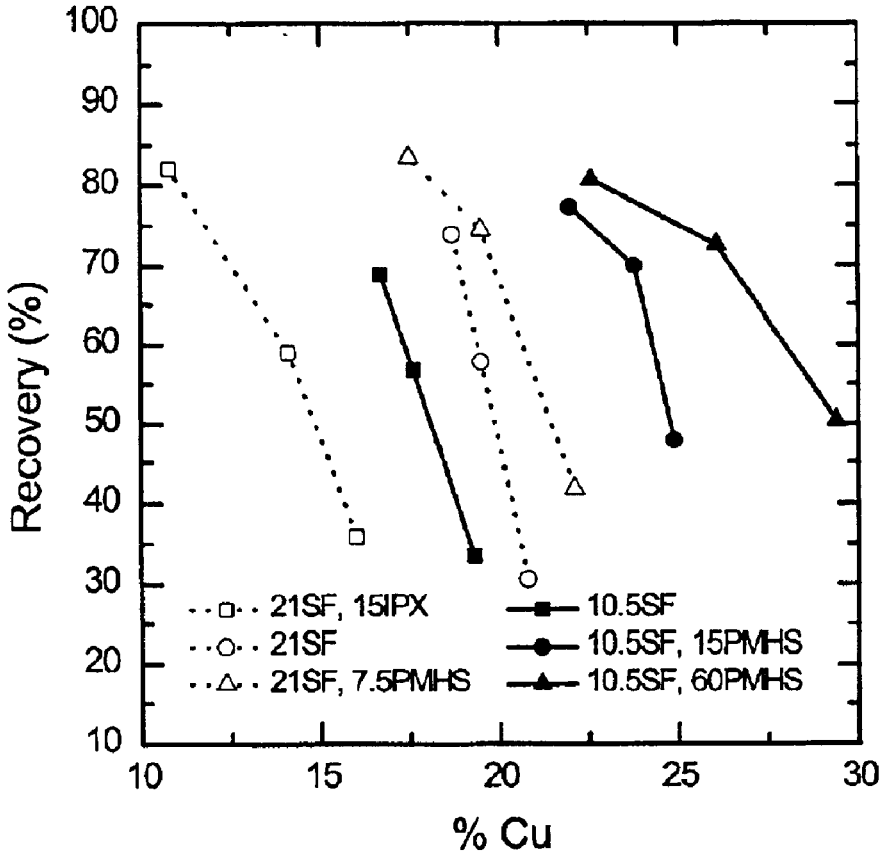
FIG. 3 is a graph of grade vs. recovery curves for example 2.
Figure 4:
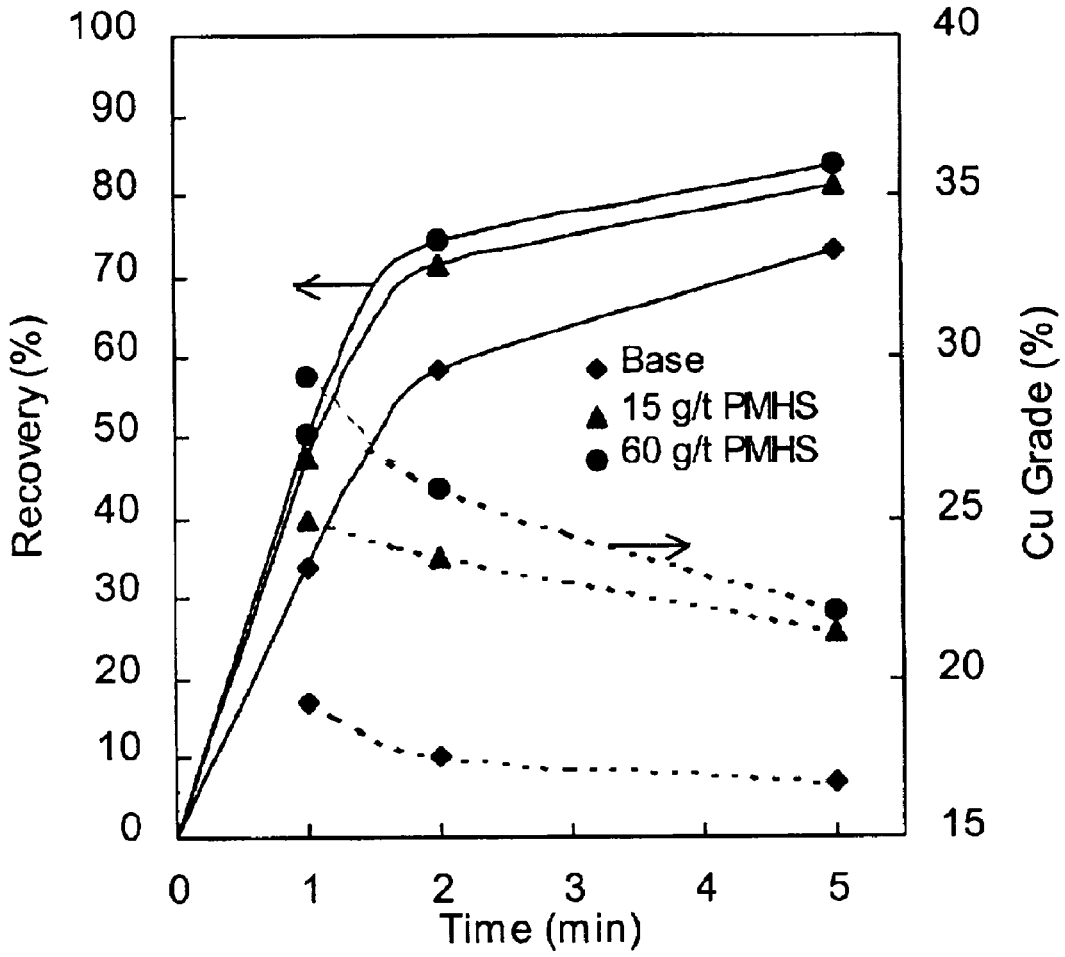
FIG. 4 is a graph of the flotation kinetics test for example 2.

In the second set, three flotation tests were conducted with 10.5 g/t Shellfloat 758 and 7.5 g/t of diesel oil. The latter was added to the mill. The tests were conducted using 0, 15 and 60 g/t PMHS to enhance the hydrophobicity of chalcopyrite. The recovery vs. time curves (solid lines), given in FIG. 4, show that the flotation rate increased in the presence of the novel hydrophobicity-enhancing reagent. It is interesting that both the recovery (solid lines) and grade (dotted lines) were increased. As a result, the recovery vs. grade curves shifted substantially as shown in FIG. 3.

Example 3

Laboratory flotation tests were conducted on a copper ore sample from Aitik Concentrator, Boliden AB, Sweden. Representative samples were taken from a classifier overflow, and floated in a Denver laboratory flotation cell. In each test, approximately 1 kg sample was conditioned for 2 minutes with 3 g/t potassium amyl xanthate (KAX), and floated for 3 minutes. The tails from the rougher flotation was reconditioned for 3 minutes with 3.5 g/t of KAX, and floated for another 4 minutes. A total of 30 g/t MIBC was used during the rougher and scavenger flotation. The rougher and scavenger concentrates were combined and analyzed. During conditioning, the pH was adjusted to 10.8 by lime addition.

In another test, flotation test was conducted using an esterified lard oil as a hydrophobicity-enhancing agent. It was used in addition to all of the reagents used in the control tests. The novel hydrophobicity-enhancing reagent was added in the amount of 7.5 g/t to the slurry after the 2 minutes of conditioning time with KAX, and conditioned for another 2 minutes.

The esterified lard oil was prepared by heating a mixture of ethanol and lard oil at approximately 60° C. while being agitated slowly. A small amount of acetic acid was used as a catalyst. The reaction product was used without purification, which should help reduce the costs of the reagents.

As shown in Table 1, the use of the hydrophobicity-enhancing agent increased the copper recovery by 2.9%, which is significant. It should be noted here that in the presence of the esterified lard oil, most of the chalcopyrite floated during the rougher flotation, and very little floated during the scavenger flotation. This observation indicated that the use of the novel hydrophobicity-enhancing reagent substantially increased the kinetics of flotation. In principle, an increase in flotation rate should result in either increased recovery or increased throughput.

TABLE 1

Results of the Flotation Tests Conducted on the Aitik Copper Ore with and without Using Esterified Lard Oil

| | Control | | | 15 g/t Esterified Lard Oil | | |
|---|---|---|---|---|---|---|
| Product | % wt | % Cu | % Recovery | % wt | % Cu | % Recovery |
| Rougher & Scavenger | 4.3 | 6.5 | 90.3 | 5.2 | 5.5 | 93.2 |
| Tails | 95.7 | 0.031 | 9.7 | 94.8 | 0.022 | 6.8 |
| Feed | 100.0 | 0.31 | 100.00 | 100.0 | 0.31 | 100.0 |

Example 4

An oxidized coal sample (3 mm x 0) from West Virginia was subjected to flotation tests using kerosene, polymethyl hydrosiloxane, and esterified lard oil. Since coal is inherently hydrophobic, all of these reagents should adsorb on the surface and enhance its hydrophobicity. The results of the flotation tests given in Table 2 show that both PMHS and esterified lard oil gave substantially higher recoveries than kerosene. At 0.6 kg/t, the latter gave 54% combustible recovery, while the former oil gave 78.2 and 93.1% recoveries, respectively.

TABLE 2

Effects of Using PMHS and Esterified Lard Oil for the Flotation of an Oxidized Coal

| | Kerosene | | PMHS | | Esterified Lard Oil | |
|---|---|---|---|---|---|---|
| Reagent Dosage (kg/t) | Ash (% wt) | Comb. Rec. (%) | Ash (% wt) | Com. Rec. (%) | Ash (% wt) | Com. Rec. (%) |
| 0.2 | 8.6 | 7.5 | 8.7 | 44.1 | 9.01 | 60.2 |
| 0.4 | 9.1 | 40.0 | 9.6 | 70.0 | 0.3 | 88.3 |
| 0.6 | 9.4 | 54.3 | 10.6 | 78.2 | 11.5 | 93.1 |

Example 5

An ultrafine bituminous (325 mesh x 0) coal is being processed at a coal preparation plant in West Virginia. The recovery was low because of the fine particle size. Sorbitan monooleate (Span 80) was tested as a hydrophobicity-enhancing reagent in full-scale operation, and the results were compared with those obtained using kerosene as collector. As shown in Table 3, kerosene gave 35% recovery, while Span 80 gave 66.8% recovery. The ash content in clean coal increased considerably, most probably because the novel hydrophobivcity-enhancing reagent increased the rate of flotation for both free coal and middlings particles. In this example, Span 80 was used as a 1:2 mixture with diesel oil. The reagent dosage given in the table includes both. In order to see the effect of the diesel oil used in conjunction with the novel hydrophobizing agent, another test was conducted using 0.33 kg/t of diesel oil alone. The results were substantially inferior to those obtained using Span 80.

TABLE 3

Comparison of the Full-scale Flotation Tests Conducted on a −325 Mesh Coal Using Kerosene, Diesel and Span 80

| Reagent | | Ash (% wt) | | | Combustible |
|---|---|---|---|---|---|
| Type | Dosage (kg/t) | Feed | Clean Coal | Refuse | Recovery (%) |
| Kerosene | 0.5 | 41.5 | 8.0 | 51.2 | 35.3 |
| Reagent U | 0.5 | 40.5 | 12.6 | 63.7 | 66.8 |
| Diesel Oil | 0.33 | 40.7 | 8.8 | 55.1 | 44.2 |

Example 6

Fatty acids are commonly used as collectors for the beneficiation of phosphate ores. However, companies face problems when phosphate ions build up in plant water. Apparently, the phosphate ions compete with the oleate ions for the adsorption sites on the mineral surface, causing a decrease in hydrophobicity. A solution to this problem would be to treat the plant water to remove the phosphate ions, which may be a costly exercise. A better solution may be to use hydrophobicity-enhancing reagents to compensate the low hydrophobicity created by fatty acids.

In this example, a phosphate ore sample from eastern U.S. was floated using two different hydrophobicity-enhancing reagents, i.e., tridecyl-dihydrogen phosphate (TDP) and soybean oil. The samples were conducted with 0.125 kg/t Tall oil fatty acid and varying amounts of TDP and soybean oil. The flotation tests were conducted for 2 minutes in mill water containing a high level of phosphate ions. The novel hydrophobicity-enhancing reagents were used as 1:2 mixtures with fuel oil. The test results are given in Table 4, where the reagent dosages include the amounts of the diesel oil. Also shown in this table are the results obtained using the fatty acid alone as a 0.6:1 mixture with the fatty acid. As shown, both TDC and soybean oil increased the recovery by approximately 10%. The low recovery obtained with the fatty acid may be attributed to the phosphate ions present in the mill water. The results given in Table 4 demonstrate that this problem can be readily overcome using the novel hydrophobicity enhancing agents developed in the present invention.

TABLE 4

Effects of Using TDP and Soybean Oil for the Flotation of a Phosphate Ore in Mill Water Containing a High Level of phosphate Ions

| | Fatty Acid | | TDP* | | Soybean Oil* | |
|---|---|---|---|---|---|---|
| Dosage (kg/ton) | $P_2O_5$ (wt %) | Recovery (%) | $P_2O_5$ (% wt) | Recovery (%) | $P_2O_5$ (% wt) | Recovery (%) |
| 0.125 | 27.2 | 6.0 | 27.1 | 74.5 | 27.5 | 73.2 |
| 0.25 | 26.8 | 71.4 | 26.8 | 93.2 | 27.3 | 80.0 |
| 0.5 | 26.6 | 86.6 | 26.3 | 96.5 | 27.2 | 95.3 |
| Feed | 16.4 | 100.0 | 16.4 | 100.0 | 16.4 | 100.0 |

*0.125 kg/t fatty acid was used.

Example 7

In Examples 6, tridecyl-dihydrogen phosphate was used in conjunction with fatty acid, where the latter renders the mineral moderately hydrophobic and the former enhances the hydrophobicity. It was found, however, that TDP could be used as a standalone collector. Table 4 compares the flotation results obtained with the same phosphate ore used in Example 6 using tap water and plant water. It shows that the phosphate ester is an excellent phosphate mineral collector, which works well independently of water chemistry.

TABLE 4

Results of the Flotation Tests Conducted Using TDP as a Phosphate Mineral Collector

| | Tap Water | | Plant Water | |
|---|---|---|---|---|
| Dosage (kg/t) | $P_2O_5$ (% wt) | Recovery (%) | $P_2O_5$ (% wt) | Recovery (%) |
| 0.25 | 27.1 | 73.2 | 27.0 | 87.1 |
| 0.50 | 23.6 | 96.7 | 26.3 | 95.9 |
| 1.00 | 23.4 | 97.1 | 26.2 | 96.7 |
| Feed | 15.4 | 100.0 | 16.4 | 100.0 |

Example 8

In many coal preparation plants, coarse coal larger than 2 mm in size is cleaned by dense-medium separators, the medium size coal in the range of 0.15 to 2 mm or 0.5 to 2 mm is cleaned by spirals, and fine coal smaller than 0.15 mm or 0.5 mm is cleaned by flotation. The spirals are used because the conventional flotation methods have difficulty in recovering particles larger than 0.5 mm.

In this example, an esterified lard oil was used as a collector for the flotation of a 2 mm x 0 coal (anthracite) sample from Korea. The results, given in Table 5, show that the use of this novel flotation reagent greatly improved the coarse coal flotation. This improvement may be attributed to the likelihood that the hydrophobicity-enhancing reagent increased the strength of the bubble-particle adhesion, and thereby decreased the probability that coarse particles are detached during flotation.

TABLE 5

Effects of Using Esterified Lard Oil for the Flotation of 2 mm × 0 Coal

| Reagent | Kerosene | | Esterified Lard Oil | |
|---|---|---|---|---|
| Dosage (kg/t) | Combustible Recovery (%) | Ash (% wt) | Combustible Recovery (%) | Ash (% wt) |
| 0.2 | 44.7 | 9.2 | 56.2 | 9.5 |
| 0.4 | 68.4 | 9.9 | 78.7 | 1.2 |
| 1.0 | 83.4 | 11.0 | 91.2 | 11.8 |

Example 9

A 2 mm x 0 Pittsburgh coal sample was subjected a flotation test, in which 0.5 kg/t PMHS was used as a hydrophobicity-enhancing reagent. The reagent was used in butanol solutions; however, it also works without the solvent. A Denver laboratory flotation machine was used at 1,400 r.p.m. with 150 g/t MIBC. The pulp density was 12.5%, and 3 minutes of conditioning time and 2 minutes of flotation time were employed. The results are given in Table 6, which also gives the results obtained with 0.5 kg/t kerosene. All other conditions were the same as with PMHS except that only 2 minutes of flotation time was employed. As shown, PMHS gave a substantially higher recovery, demonstrating that the use of a hydrophobicity-enhancing reagent disclosed in the present invention is useful for floating coarse particles.

TABLE 6

Comparison of the Flotation Results Obtained with PMHS and Kerosene on a 2.0 mm × 0 Pittsburgh Coal Sample

| | Kerosene | | PMHS | |
|---|---|---|---|---|
| Product | Ash Content (% wt) | Combust. Recovery (%) | Ash Content (% wt) | Combust. Recovery (%) |
| Clean Coal | 6.8 | 88.2 | 8.2 | 98.0 |
| Reject | 47.0 | 11.8 | 80.8 | 2.0 |
| Feed | 14.5 | 100.0 | 14.5 | 100.0 |

Example 10

The coarse kaolin clay mined in middle Georgia contains colored impurities anatase ($TiO_2$) and iron oxide. The former is removed by flotation, and the latter is chemically leached in sulfuric acid in the presence of sodium hydrosulfite. However, the removal of anatase from the east Georgia clay is a challenge, as 90% of the particles are finer than 2 $\mu$m. In the present example, an east Georgia clay containing 3% $TiO_2$ was blunged with 4 kg/t sodium silicate and 1.5 kg/t ammonium hydroxide in a kitchen blender. The clay slip was then conditioned with different amounts of Aero 6793 (alkyl hydroxamate) and floated at 25% solids. The results are given in Table 7. The best results were obtained with 1 kg/t Aero 6973 and 0.5 kg/t PMHS, which show that the use of a hydrophobicity-enhancing reagent is useful for increasing the kinetics of flotation of ultrafine particles. A small amount of butanol was used as solvent for PMHS.

TABLE 7

Effects of Using PMHS for the Removal of Anatase from an East Georgia Kaolin by Flotation

| % $TiO_2$ in Product | Weight Recovery (%) 1 kg/t Aero 6973 | 1.5 kg/t Aero 6973 | 1 kg/t Aero 6973 & 0.56 kg/t PMHS |
|---|---|---|---|
| 2.0 | 83.5 | 89.1 | 93.4 |
| 1.5 | 72.0 | 83.2 | 88.1 |
| 1.0 | — | 70.2 | 78.5 |

I claim:

1. A process of separating hydrophobic and hydrophilic particles dispersed in an aqueous slurry, the process comprising:

adding a hydrocarbon oil to increase the hydrophobicity of said hydrophobic particles;

providing at least one hydrophobicity-enhancing reagent in the aqueous slurry to further increase the hydrophobicity of said hydrophobic particles, said at least one hydrophobicity-enhancing reagent not including a hydrocarbon oil and provided in an amount equal to or less than 0.6% of the weight hydrophobic particles in said slurry;

agitating the aqueous slurry to aid said hydrophobicity-enhancing reagent in adsorbing on the surface of the hydrophobic particles, whereby the hydrophobicity of the hydrophobic particles is increased;

providing air bubbles in the aqueous slurry, whereby the hydrophobic particles collect on the surface of the air bubbles, thereby forming bubble-particle aggregates; and allowing the bubble-particle aggregates to float to the surface of the aqueous slurry to be separated from the hydrophilic particles.

2. The process according to claim 1, the process further comprising providing at least one solvent mixed with said at least one hydrophobicity-enhancing reagent in the aqueous slurry.

3. The process according to claim 2 wherein the at least one solvent is selected from the group consisting of light hydrocarbon oils and short-chain alcohols having a carbon number less than eight.

4. The process according to claim 1, said process further comprising providing at least one of a dispersant and an emulsifier to aid dispersion of the hydrophobicity-enhancing reagent.

5. The process according to claim 1 wherein the hydrophobic particles are nonpolar.

6. A process of seperating hydrophobic and hydrophilic particles dispersed in an aqueous slurry, the process comprising:

adding a hydrocarbon oil to increase the hydrophobicity of said hydrophobic particles;

providing at least one hydrophobicity enhancing reagent in the aqueous slurry to further increase the hydrophobicity of said hydrophobic particles, said hydrophobicity enhancing reagent comprising a mixture of esters;

agitating the aqueous slurry to aid said mixture of esters in adsorbing on the surface of the hydrophobic particles, whereby the hydrophobicity of the hydrophobic particles is increased;

providing air bubbles in the aqueous slurry, whereby the hydrophobic particles collect on the surface of the air bubbles, thereby forming bubble-particle aggregates; and allowing the bubble-particle aggregates to float to the surface of the aqueous slurry to be separated from the hydrophilic particles.

7. The process according to claim 6 wherein the mixture of esters is formed by transesterfication of a naturally occurring lipid.

8. The process according to claim 6 wherein the modified lipid comprises a lipid modified by interesterification.

9. A process of separating a first particulate material from a second particulate material in an aqueous slurry, the process comprising:

agitating the aqueous slurry with at least one collector to render said first particulate material hydrophobic;

agitating the aqueous slurry with at least one nonionic hydrophobicity-enhancing reagent to allow the surface of said first particulate material to become more hydrophobic;

providing air bubbles in the aqueous slurry to form bubble-particle aggregates with said first particulate material; and allowing the bubble-particle aggregates to float to the surface of the aqueous slurry to be separated from said second particulate material, wherein sad first particulate material is a sulfide mineral and said collector is a thiol-type hydrophobizing reagent.

* * * * *